US008132711B2

(12) United States Patent
Clark

(10) Patent No.: US 8,132,711 B2
(45) Date of Patent: Mar. 13, 2012

(54) EMERGENCY INFORMATION CONTAINER

(76) Inventor: Tamara Ann Clark, Gregory, MI (US)

( * ) Notice: Subject to any disclaimer, the term of this patent is extended or adjusted under 35 U.S.C. 154(b) by 1066 days.

(21) Appl. No.: 12/002,852

(22) Filed: Dec. 19, 2007

(65) Prior Publication Data

US 2008/0156854 A1 Jul. 3, 2008

Related U.S. Application Data

(60) Provisional application No. 60/876,583, filed on Dec. 22, 2006.

(51) Int. Cl.
*B65D 27/00* (2006.01)

(52) U.S. Cl. ..... 229/68.1; 383/71; 383/76

(58) Field of Classification Search ..... 229/68.1, 229/76, 77, 80, 79, 80.5, 307; 40/124.04
See application file for complete search history.

(56) References Cited

U.S. PATENT DOCUMENTS

| | | | | |
|---|---|---|---|---|
| 295,598 | A * | 3/1884 | Trum | 229/76 |
| 902,648 | A * | 11/1908 | Drinkwater | 229/76 |
| 2,442,646 | A * | 6/1948 | Fields | 222/213 |
| 3,083,904 | A * | 4/1963 | Brenner et al. | 360/131 |
| 3,139,230 | A * | 6/1964 | Knittel | 229/76 |
| 3,237,327 | A * | 3/1966 | Griggs | 40/643 |
| 3,349,226 | A * | 10/1967 | Goldstern | 235/489 |
| 3,489,332 | A * | 1/1970 | Knittel | 229/80 |
| 3,949,935 | A * | 4/1976 | Stackig | 229/68.1 |
| 3,958,690 | A | 5/1976 | Gee, Sr. | |
| 4,579,277 | A * | 4/1986 | Gendron | 229/74 |
| 5,171,039 | A | 12/1992 | Dusek | |
| 5,380,046 | A | 1/1995 | Stephens | |
| 5,507,525 | A * | 4/1996 | Leuenberger | 283/67 |
| 5,836,453 | A * | 11/1998 | Herrera | 206/702 |
| 6,116,655 | A | 9/2000 | Thouin et al. | |
| 6,446,374 | B1 | 9/2002 | Ardiff | |
| 7,350,687 | B2 * | 4/2008 | Sanchez et al. | 229/80 |
| 2003/0059751 | A1 | 3/2003 | Welles | |
| 2004/0094609 | A1 * | 5/2004 | Mori | 229/80 |
| 2004/0134977 | A1 * | 7/2004 | O'Dwyer et al. | 229/80 |
| 2004/0166276 | A1 * | 8/2004 | De La Motte-Bouloumie et al. | 428/40.2 |
| 2004/0267685 | A1 | 12/2004 | Sharland et al. | |
| 2005/0045707 | A1 * | 3/2005 | Stude | 229/308 |
| 2007/0023492 | A1 * | 2/2007 | Stude | 229/308 |

FOREIGN PATENT DOCUMENTS

| | | |
|---|---|---|
| WO | WO/2004/044857 | 5/2004 |
| WO | WO/2007/061651 | 5/2007 |

* cited by examiner

*Primary Examiner* — Nathan J Newhouse
*Assistant Examiner* — Peter Helvey
(74) *Attorney, Agent, or Firm* — Tamara A. Clark

(57) ABSTRACT

A container with an opening on one end, with an adhesive flap to seal the container once the desired information and objects are placed therein; said container may then be affixed to a surface, thereby creating a convenient way to keep necessary emergency information both readily available and private.

18 Claims, 1 Drawing Sheet

A-1

EMERGENCY INFORMATION CONTAINER

BACKGROUND AND SUMMARY OF INVENTION

The present invention relates generally to personal information containers, but diverges in that the invention is not designed to contain mere information cards (although information cards and identification cards may be placed inside), and the present invention is not designed to fit inside a wallet. This invention is created to fit a few sheets of standard-size paper (when folded down to one-eighth size). Also, the present invention is intended to be affixed to the surface of an object, such as a car seat, booster seat, travel system, stroller, or comparable object that may be used for children, handicapped persons, and the elderly.

As a parent, I am faced with the frustrating task of trying to keep myself and others prepared in the event an emergency arises with my child. Friends and family tend to assume "nothing will happen," and I get the impression they are not listening to emergency instructions, or are at risk for misplacing such written instructions. Because the risks of an accident or medical emergency are always present, there is a need for a simple way to have information available, yet private until needed.

The conventional practice of carrying identification and other personal or medical information directly on one's person is grossly inadequate for children, handicapped persons, and sometimes the elderly. And passing such potentially sensitive information from one caregiver to the next is equally inadequate, especially in situations where one caregiver may be authorized to make emergency medical treatment decisions while another may not. The present invention eliminates the need to pass such information from one caregiver to the next by creating a way to securely and privately affix such information to an object that travels with the individual being cared for. A child's car seat or booster seat, a handicapped person's wheelchair, and an elderly person's oxygen tanks are all examples of such object that commonly remain with the individual.

In certain circumstances, if an adult and an infant are involved in an automobile accident, and the adult is unconscious or otherwise incoherent, emergency personnel have no way of knowing whether or not the child even belongs to the adult, or whether the child is allergic to common medications like penicillin. In other circumstances, an elderly person who is still driving may benefit from this invention by affixing said invention to the side of their driver seat. Thus, if an emergency arises while they are driving and they are unable to communicate information such as what medication(s) they are taking, such information can be quickly retrieved. The present invention intends to reduce such risks by providing a convenient way to have such information available. In all circumstances, the sealed nature of the present invention intends to reduce the risks of identity theft; in certain circumstances the invention may also protect those being cared for by precluding strangers from familiarizing themselves with their personal information.

According to the present invention an emergency information container comprises a rectangular-shaped container made of opaque or translucent plastic, vinyl (including, but not limited to, polyvinyl chloride, polyvinylidene chloride, ethylene vinyl acetate, polyethylene vinyl acetate, polyvinyl acetate and polyvinyl butyral), or similar substance, or a combination thereof, sealed on three sides, with an opening at one end, and a plat that affixes to the backside of the invention using an adhesive, hook and loop fasteners such as VELCRO®, snap, tie or similar substance/object to seal the open end, and a method for affixing the back-side of the sealed rectangular container to an object, such as adhesive, snaps, hook and loop fasteners such as VELCRO®, nails, or similar substances and/or objects. The front side of the invention shall contain a word or words to alert potential rescuers that pertinent personal information is enclosed, in one or more languages, and also alert such persons that the invention should be removed and opened in the event of an emergency. The invention shall be accompanied with stickers stating "emergency information on back," "emergency information below," or similar language, thereby alerting potential rescuers that, although not immediately apparent, important emergency information is somewhere on the object on which the sticker is placed. In one construction, the container may be treated with a flame-retardant or fire-resistant substance.

BRIEF DESCRIPTION OF THE DRAWINGS

The invention can be performed in various ways but one embodiment will now be described by way of example, and with reference to the accompanying drawings, in which.

DETAILED DESCRIPTION AND BEST MODE OF CARRYING OUT THE INVENTION

Figures 1, 2:
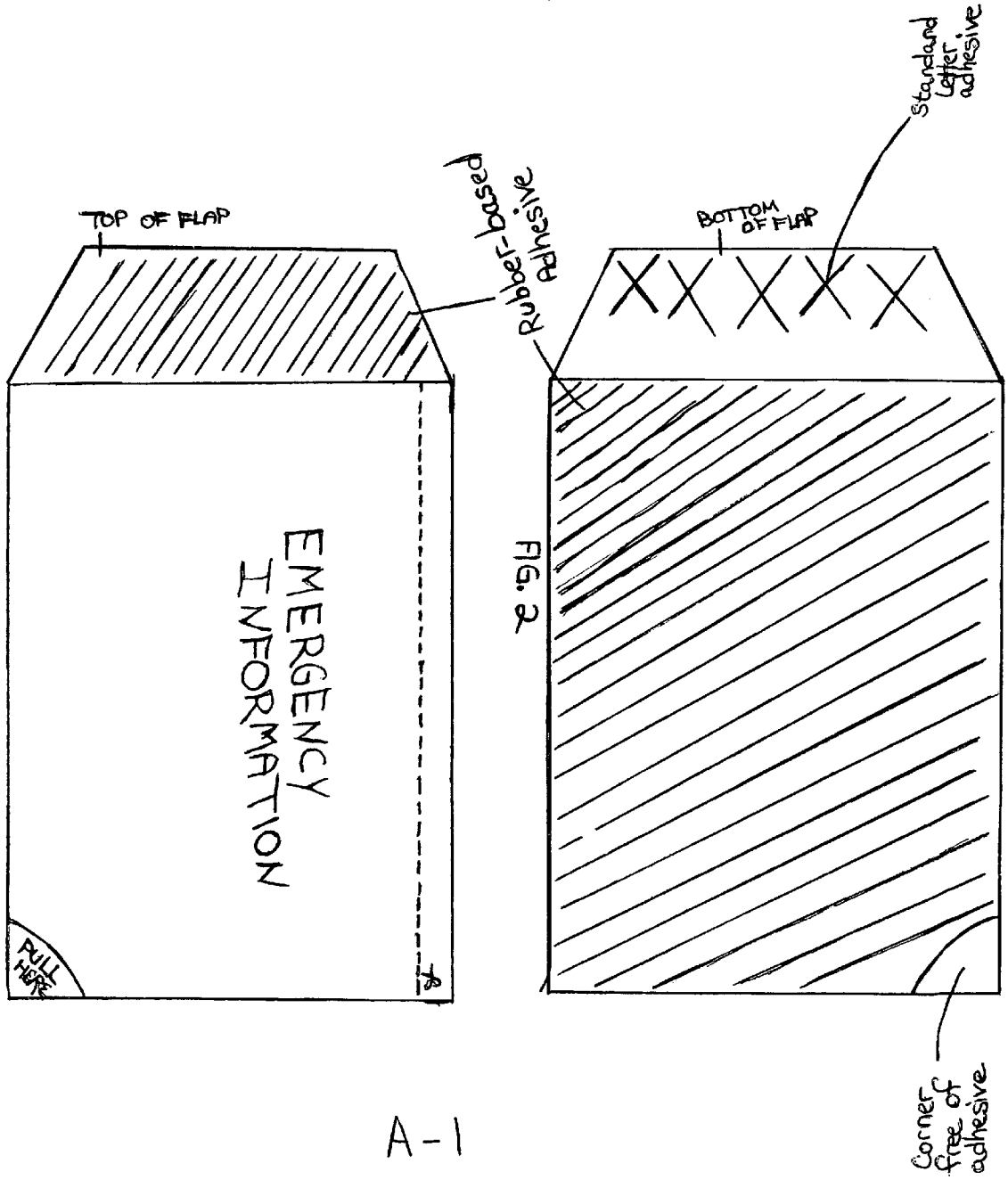
FIG. 1 is a frontal view of the container.
FIG. 2 is a view of the backside of the container

In a preferred construction, the container may be dimensioned to be 5 inches long and 3.5 inches wide. This allows a standard sheet of paper, folded to one-eighth size, to fit comfortably inside, as well as identification and information cards and other similar objects. After measuring the available space on a number of infant car seats, toddler car seats, booster seats, travel systems, and strollers, this appears to be the most convenient size as it will fit on most of the above mentioned objects and is still a convenient size to put in one or more standard-size sheets of paper, folded to one-eighth size.

In a preferred construction, the container shall be made of 12 mil polyvinyl chloride. This form of plastic is inherently flame-resistant, and 12 mil thickness of the material is sufficiently strong to withhold indoor and outdoor use, and will withstand being peeled from the object to which it is affixed.

In a preferred construction, the three sealed sides of the invention shall be heat-sealed to ensure the highest degree of water-resistance.

In a preferred construction, the contrast between the background color and the color of the word or words written on the front of the invention shall be sufficient to attract the attention of rescuers.

In a preferred construction, one corner of the rectangular container shall be free of adhesive, screws, hook and loop fasteners such as VELCRO®, nails, and other similar substances/objects to provide for more efficient removal of said container from the surface to which it is affixed.

In a preferred construction, the flap used to seal the container shall seal on the back-side of the rectangular container, so that upon sealing and affixing the container to a surface it will make it difficult to open the container without first removing the container from the surface to which it is affixed. This makes it more difficult for unauthorized persons to discreetly view the information enclosed in the container. In the event of an emergency, rescuers are to either (i) use sufficient force to remove the invention from the object it is adhered to, and open it via breaking the seal closing the flap, or (ii) cut along the dotted line shown on the front of the invention.

In a preferred embodiment, rubber-based adhesive shall be used to affix the back-side of the invention to the desired object. A rubber-based adhesive will securely and quickly fasten the invention to the desired surface, including uneven surfaces, while still allowing for fast removal when sufficient force is used.

In a preferred embodiment, a pressure sensitive adhesive shall be used to seal the flap to the backside of the invention prior to affixing the invention to the desired surface, and said pressure sensitive adhesive shall be less tacky than the adhesive used to affix the back-side of the invention to an object, thus when sufficient force is used to remove the invention from the object the sealed flap will be pulled apart, thereby reducing the amount of time needed to retrieve the information inside the invention.

What is claimed is:

1. An emergency information container comprising:

a flexible enclosure having a first sheet and a second sheet, each sheet having a plurality of edges, where the first sheet and the second sheet are sealed together on all edges except one; and a flap on the unsealed edge of the enclosure to enable a user to insert emergency information and to use the flap on the unsealed edge of the enclosure to enclose the emergency information inside the enclosure by sealing the flap to a rear surface of the enclosure;

wherein the dimensions of the enclosure are such that the enclosure is capable of holding at least one standard-size sheet of paper (8½"×11"), when folded;

wherein the rear surface of the enclosure and an outward facing surface of the closed flap are coated with an adhesive for affixing the sealed enclosure to a desired surface such that the flap and the rear surface of the enclosure are adhered to the desired surface, thereby making the flap inaccessible; and wherein the adhesive used to seal the flap of the enclosure closed is less tacky than the adhesive used to adhere the sealed enclosure to the desired surface so as to cause the flap to be opened upon removing the enclosure from the surface to which it is affixed, thereby reducing the amount of time needed to retrieve the emergency information contained therein.

2. The emergency information container as recited in claim 1, wherein a corner of the rear surface of the enclosure is free of adhesive so as to enable the user and/or rescuer to efficiently remove the enclosure from the surface to which it is affixed, and further enabling the user and/or rescuer to lift the flap of the enclosure and remove the emergency information contained therein.

3. The emergency information container as recited in claim 1, wherein the enclosure is opaque or translucent and capable of indoor and outdoor use.

4. The emergency information container as recited in claim 1, wherein the enclosure is flame-retardant or fire-resistant, and is water-resistant.

5. The emergency information container as recited in claim 1, wherein the adhesive is a rubber-based adhesive.

6. An emergency information container comprising:

a flexible enclosure having a first sheet and a second sheet, each sheet having a plurality of edges, where the first sheet and the second sheet are sealed together on all edges except one; and a flap on the unsealed edge of the enclosure to enable a user to insert emergency information and to use the flap on the unsealed edge of the enclosure to enclose the emergency information inside the enclosure by sealing the flap to a rear surface of the enclosure;

wherein the dimensions of the enclosure are such that the enclosure is capable of holding at least one standard-size sheet of paper (8½"×11"), when folded; and wherein the rear surface of the enclosure and an outward facing surface of the closed flap are coated with an adhesive or include screws, nails or other affixing materials for affixing the sealed enclosure to a desired surface such that the outward facing surface of the closed flap and the rear surface of the enclosure are adhered to the desired surface, thereby making the flap inaccessible once the enclosure is adhered to the desired surface, wherein the adhesive used to seal the flap of the enclosure closed is less tacky than the adhesive used to adhere the sealed enclosure to the desired surface so as to cause the flap to be opened upon removing the enclosure from the surface to which it is affixed, thereby reducing the amount of time needed to retrieve the emergency information contained therein.

7. The emergency information container as recited in claim 6, wherein the enclosure includes a word or words and/or a symbol or symbols on a front side of the enclosure indicating that emergency information is enclosed inside, and the front side of the container also includes a word or words and/or a symbol or symbols indicating how to cut open the enclosure to retrieve the emergency information contained therein.

8. The emergency information container as recited in claim 6, wherein a corner of the rear surface of the enclosure is free of adhesive, screws, nails, or other affixing materials, so as to enable the user and/or rescuer to efficiently remove the enclosure from the surface to which it is affixed, and further enabling the user and/or rescuer to lift the flap of the enclosure and remove the emergency information contained therein.

9. The emergency information container as recited in claim 6, wherein the enclosure is opaque or translucent.

10. The emergency information container as recited in claim 6, further including stickers that alert potential rescuers that important emergency information is available nearby.

11. The emergency information container as recited in claim 6, wherein the enclosure is flame-retardant or fire-resistant.

12. The emergency information container as recited in claim 6, wherein the enclosure is made of 12 mil polyvinyl chloride.

13. The emergency information container as recited in claim 6, wherein the enclosure is capable of indoor and outdoor use.

14. The emergency information container as recited in claim 6, wherein the enclosure is water-resistant.

15. The emergency information container as recited in claim 7, wherein the contrast between a color of the front surface of the enclosure and a color of the word or words written on the front surface of the enclosure are sufficient to attract the attention of rescuers.

16. The emergency information container as recited in claim 6, wherein the adhesive is a rubber-based adhesive.

17. The emergency information container as recited in claim 6, wherein the enclosure includes a word or words and/or symbol or symbols on a front side of the enclosure indicating that emergency information is enclosed inside, and the front side of the container also includes a word or words and/or a symbol or symbols indicating how to cut open the enclosure to retrieve the emergency information contained therein.

18. The emergency information container as recited in claim 17, wherein the contrast between a color of the front surface of the enclosure and a color of the word or words written on the front surface of the enclosure are sufficient to attract the attention of rescuers.

* * * * *